United States Patent [19]

Marcade et al.

[11] Patent Number: 4,820,934

[45] Date of Patent: Apr. 11, 1989

[54] DISPENSER CONTROL FOR DISHWASHERS

[75] Inventors: Roque Denis Marcade, Lincoln Township, Berrien County, Mich.; Daniel S. Query, Antioch, Tenn.

[73] Assignee: Whirlpool Corporation, Benton Harbor, Mich.

[21] Appl. No.: 134,994

[22] Filed: Dec. 18, 1987

[51] Int. Cl.[4] ..... H01H 51/27; B01F 3/00

[52] U.S. Cl. ..... 307/41; 307/142; 307/38; 134/57 D; 134/58 R; 68/12 R

[58] Field of Search ..... 307/34–41, 307/141, 141.4, 141.8, 142; 134/56 R, 56 D, 57 R, 57 D, 58 R, 58 D; 361/191; 68/17 R, 17 A, 12 R, 12 A, 23.4, 23.5; 222/52, 57, 214, 129, 651, 516, 504, 517; 323/229, 230, 237, 239, 324, 325

[56] References Cited

U.S. PATENT DOCUMENTS

| | | | |
|---|---|---|---|
| 3,180,999 | 4/1965 | Kuykendall | 307/41 |
| 3,335,319 | 8/1967 | Warner | 307/41 X |
| 3,439,673 | 2/1976 | Thibaut | 68/12 R |
| 3,510,026 | 5/1970 | Wright | 68/12 R X |
| 3,539,153 | 11/1970 | Wennerberg | 134/57 D X |
| 3,543,139 | 11/1970 | Greene | 307/38 X |
| 3,865,710 | 2/1975 | Phipps | 307/39 X |
| 3,881,328 | 5/1975 | Kleimola et al. | |
| 3,888,269 | 6/1975 | Bashark | |
| 3,927,541 | 12/1975 | Thibaut | 68/12 R |
| 3,937,981 | 2/1976 | Nysten et al. | 134/58 R X |
| 3,969,925 | 3/1974 | Breeding | |
| 4,213,059 | 7/1980 | Deacey | 307/41 |
| 4,213,313 | 7/1980 | Kiefer et al. | 307/141.4 X |
| 4,329,596 | 5/1982 | Marcade | |
| 4,517,651 | 5/1985 | Kawasaki | |
| 4,528,456 | 7/1985 | Harris | 307/38 X |
| 4,593,361 | 6/1986 | Otten | |

*Primary Examiner*—William M. Shoop, Jr.
*Assistant Examiner*—Paul Ip
*Attorney, Agent, or Firm*—Hill, Van Santen, Steadman & Simpson

[57] ABSTRACT

A control circuit for dispensing detergent and a wetting agent in a dishwasher is provided in which a single triac can be utilized to selectively energize either the detergent dispenser operator or the wetting agent dispenser operator by connecting the two operators, each in series with an oppositely oriented diode, in parallel, and such connection in series with the triac, and then biasing the triac into low impedance at the beginning of either positive or negative half line cycle depending on the operator selected to be energized. If an operator is of low resistance, it is connected in series with the heater which then acts as a current limiter, and if the operator is of high impedance, it is connected in parallel with the heater.

13 Claims, 3 Drawing Sheets

FIG. 4
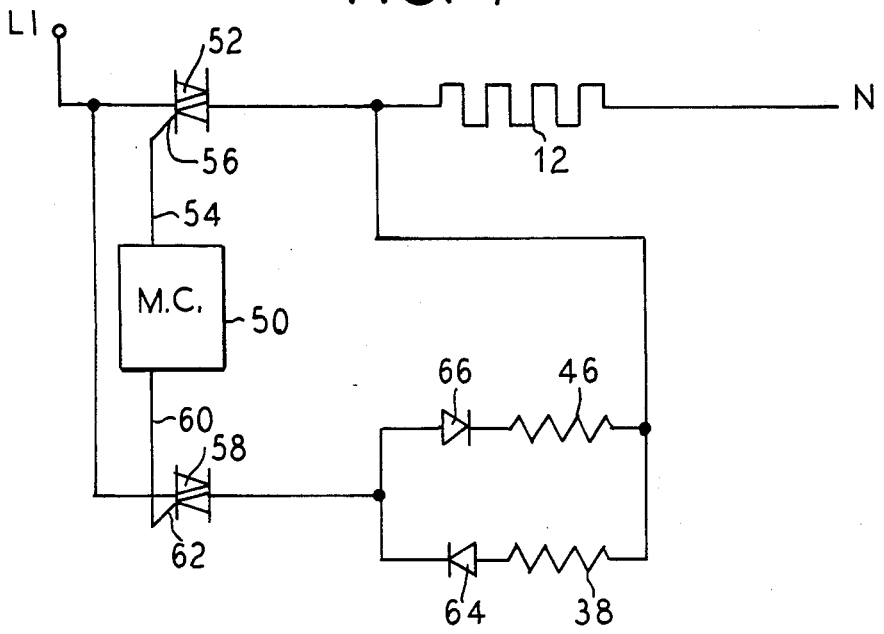
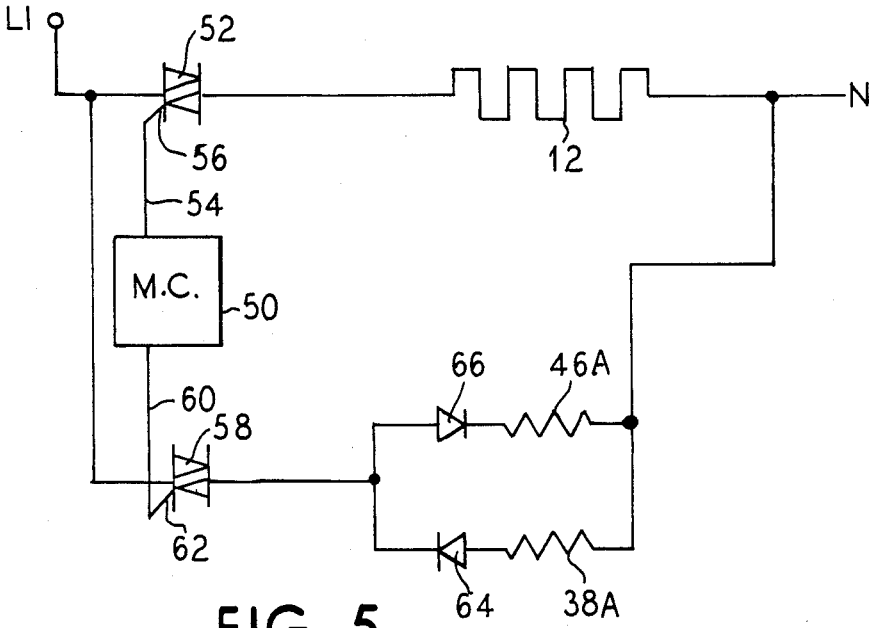
FIG. 5

DISPENSER CONTROL FOR DISHWASHERS

BACKGROUND OF THE INVENTION

1. Field of the Invention

This invention relates to dishwasher apparatus, and in particular to means for controlling the dispensing of dishwashing liquid additive selectively in the operation of the dishwasher apparatus.

2. Description of the Prior Art

Domestic dishwashing apparatus generally have two separate additive dispensers, one for a dishwashing detergent and one for a wetting agent. The dispensers are actuated automatically during a desired portion of the wash cycle to dispense an appropriate additive to the wash chamber.

U.S. Pat. No. 4,329,596, owned by the assignee hereof, discloses a dishwasher dispenser control which utilizes two separate relays 22, 23 to operate switches to place one or both of the detergent dispenser operator and wetting agent dispenser operator in series with the electrical heating coil to effect dispensing of those additives.

U.S. Pat. No. 3,888,269, owned by the assignee of the present invention discloses the use of three separate triacs 64, 71 and 66 to control the heater 23, detergent dispenser 73 and wetting agent dispenser 67 respectively.

SUMMARY OF THE INVENTION

The present invention provides an improved control circuit for operating the additive dispensers in a dishwasher by utilizing a single triac to control two separate dispenser actuators. The actuators are operated by a single triac which is fired during a selected positive or negative half wave line cycle to operate the desired dispenser. Dependent upon whether the actuators are of a high resistance or low resistance, the actuators are connected either in parallel or series with the heating element.

BRIEF DESCRIPTION OF THE DRAWINGS

FIG. 4 is a schematic wiring diagram showing the improved circuit of the invention.

FIG. 5 is a schematic diagram showing an alternative embodiment of the improved circuit of the invention.

DETAILLED DESCRIPTION OF THE PREFERRED EMBODIMENTS

Figure 1:
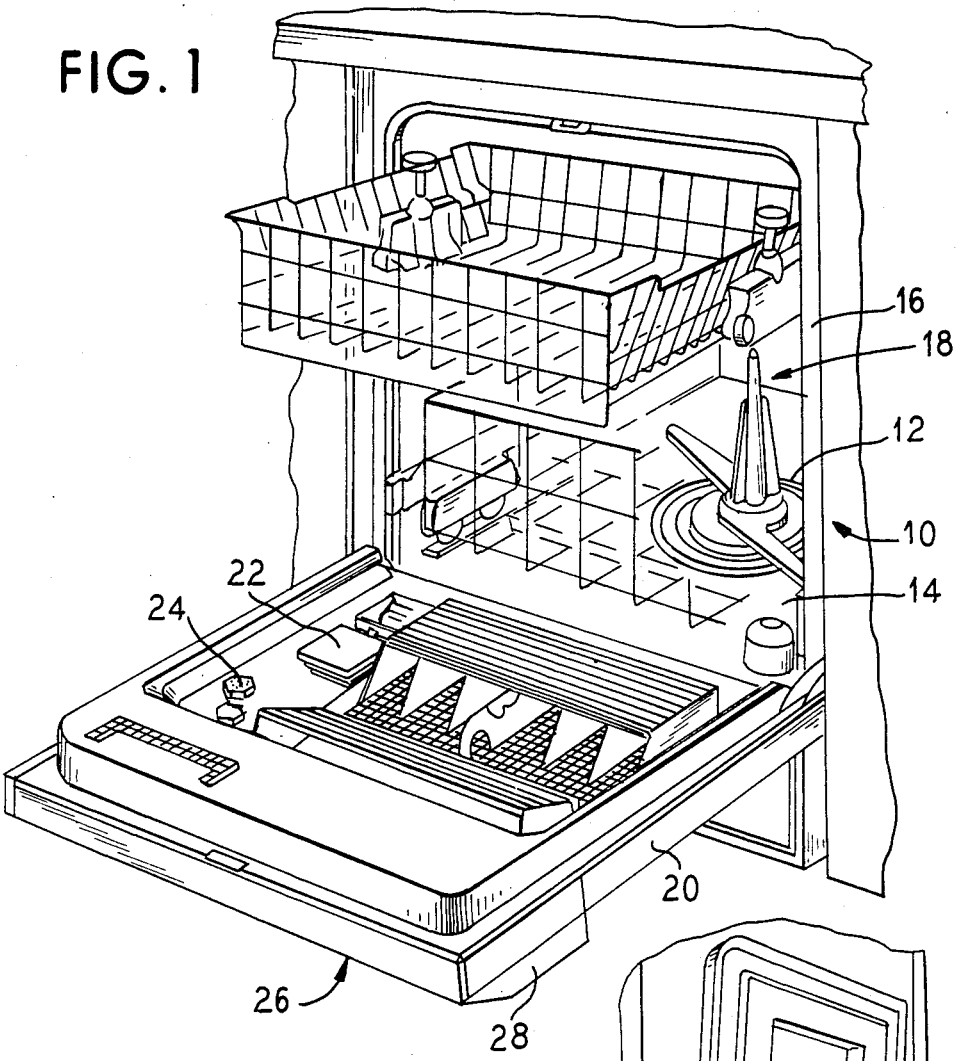
FIG. 1 is a perspective view of a dishwasher having an improved control circuitry embodying the invention and illustrating the detergent and wetting agent dispensers in a front door thereof.

In FIG. 1 a dishwasher is generally designated at 10 which is provided with a heater 12 in a bottom portion 14 of a housing 16 thereof defining a washing chamber 18. The chamber is selectively closed by a front door 20.

In the illustrated embodiment, a detergent dispenser 22 and a wetting agent dispenser 24 are mounted on the door 20 so as to be exposed to the washing chamber 18 when the door is in the closed position.

A control 26 for operating the dishwasher through washing, rinsing and drying operations is mounted in a control panel 28 at an upper portion of the door 20.

The detergent dispenser 22 includes a receptacle 30 which is selectively enclosed by a pivotable cover 32 normally held open by a spring 34 but which can be latched into a closed position and held in that position by means of a finger 36. At a selected time during the wash cycle an actuator 38, which may be in the form of a bi-metallic heater element or solenoid, can be energized to pivot the finger 36 to release its engagement with the cover 32 permitting the spring 34 to cause the cover to open and to expose the receptacle 30 to the wash chamber 18.

Figure 3:
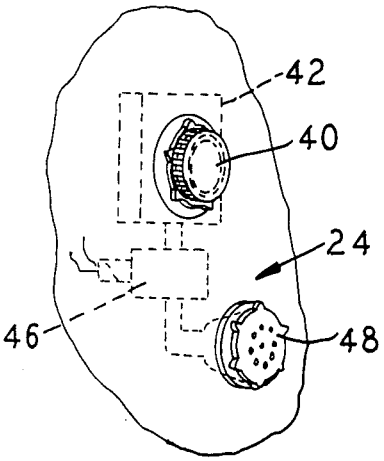
FIG. 3 is a perspective view of the wetting agent dispenser and control actuator.
Figure 2:
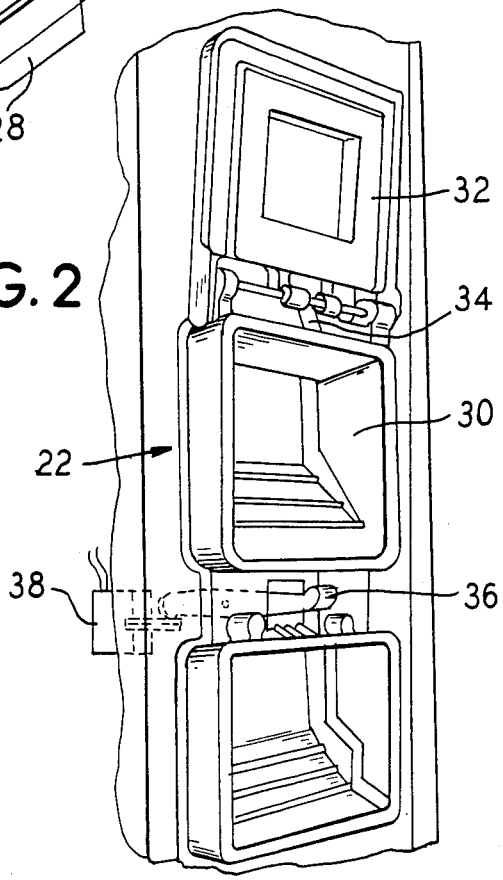
FIG. 2 is a side perspective view of the detergent dispenser and dispensing actuator.

FIG. 3 illustrates the wetting agent dispenser 24 which includes a selectively removable cap 40 for providing access to a reservoir 42 for filling purposes. An actuator 46, which may be in the form of a bi-metallic heater element or a wax motor causes wetting agent to be dispensed through an apertured cap 48 into the wash chamber 18.

The detergent dispenser actuator 38 and the wetting agent actuator 46 are each selectively energized at appropriate portions during the wash cycle to dispense the desired additives into the wash chamber.

FIG. 4 illustrates a schematic wiring diagram of a control for operating the heater 12, the detergent dispenser actuator 38 and the wetting agent dispenser actuator 46. A microcomputer 50 is provided which selectively operates a first triac 52 to control energization of the heater 12. Triacs, which are well known in the electronics art, normally exhibit a high impedance between their end terminals in and exhibit a low impedance between their end terminals in their end terminals in response to the application of a signal, having an amplitude greater than a predetermined magnitude, to their third or gate terminal. Thus, when the microcomputer 50 causes a signal to be sent on line 54 to a gate terminal 56 of the triac 52, the impedance of the triac is changed to a low impedance thus providing line voltage directly to the heater 12. The triac stays in a low impedance condition until the current passing therethrough falls below a certain minimum amount, close to a no current condition which occurs twice in each line cycle. Thus, energization of the heater 12 would either require a continuous signal to be applied at the gate terminal 56 by the micro-computer or would require the triac to be fired at the rate of 120 times per second just after the line current passes through zero between positive and negative.

The microcomputer also controls a second triac 58 by means of a line 60 leading to a gate terminal 62 of that triac. The second triac 58 is connected through parallel circuits, each having an oppositely directed diode 64, 66 and a dispenser actuators 38, 46.

Figure 7:
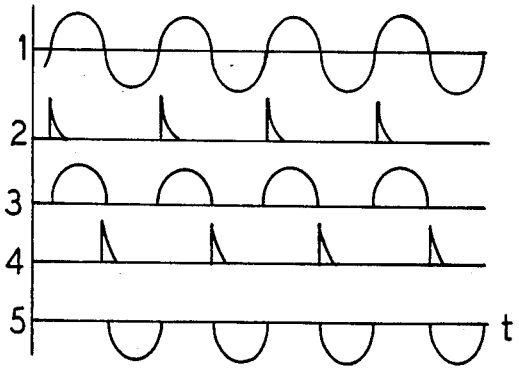
FIG. 7 is a timing diagram illustrating line current and firing times for the triac to alternatively control the wetting agent dispenser actuator or detergent dispenser actuator.

In order to energize the detergent dispenser actuator 38, negative half line cycles are directed through the actuator 38 by firing the second triac 58 at gate 62 by a pulse such as that shown on line 4 of FIG. 7 which is timed to be synchronous with the beginning of a negative half cycle of the line current as illustrated on line 1 of FIG. 7. This causes negative half cycles, such as shown at line 5 of FIG. 7 to pass through the triac 58 since the triac returns to a state of high impedance when the current flowing therethrough again approaches close to zero. Diode 66, which is reverse biased, does not permit negative half cycles to pass through it, however diode 64, which is forward biased, does since it is in a reversed position. Thus, current flows through actuator 38.

In order to energize actuator 46, the triac 58 is fired with signals such as those illustrated on line 2 of FIG. 7 which are synchronous with the beginning of a positive half line cycle and result in positive half line cycles, such as those shown in line 3, which pass through the triac 58. These positive half line cycles are blocked by diode 64, but diode 66 permits passage of the positive half line cycles thus permitting current to flow through actuator 46.

Actuators 38 and 46 shown in FIG. 4 are low resistance elements such as bi-metallic heaters and, because half cycles of line voltage are applied to those elements, the elements are in turn connected in series with the heater 12 which has a high resistance in order to reduce the current flowing through the actuators to avoid a near short circuit situation. Since it is more desirable to put heat into the wash chamber rather than the area of the control circuit to the exclusion of the wash chamber, the series connection through the heater element is preferred over a separate current limiting resistor in the control circuitry. Also, the cost of a separate current limiting resistor is avoided.

If it is desired to have the heater on at full power while one of the actuators is being energized, then the microcomputer 50 must send alternating signals on lines 54 and 60 so that half line cycles will pass through one of the actuators while the opposite line cycle will continue directly toward the heater element. Thus the heater element will in effect see a full line cycle passing therethrough.

FIG. 5 illustrates an alternative embodiment of the control circuit wherein a detergent dispensing actuator 38A and a wetting agent dispenser actuator 46A are of a high resistance type device, which could be a solenoid, and which can operate on a voltage drop of approximately 55–60 volts. Because of the high resistance of the actuators, the actuators are now connected in parallel to the heater 12 and do not require the heater to act as a current limiting resistor. The circuit of FIG. 5 is otherwise identical to that of FIG. 4 except that power to the heater is controlled solely by triac 52 whether either or both actuators are on.

Figure 6:
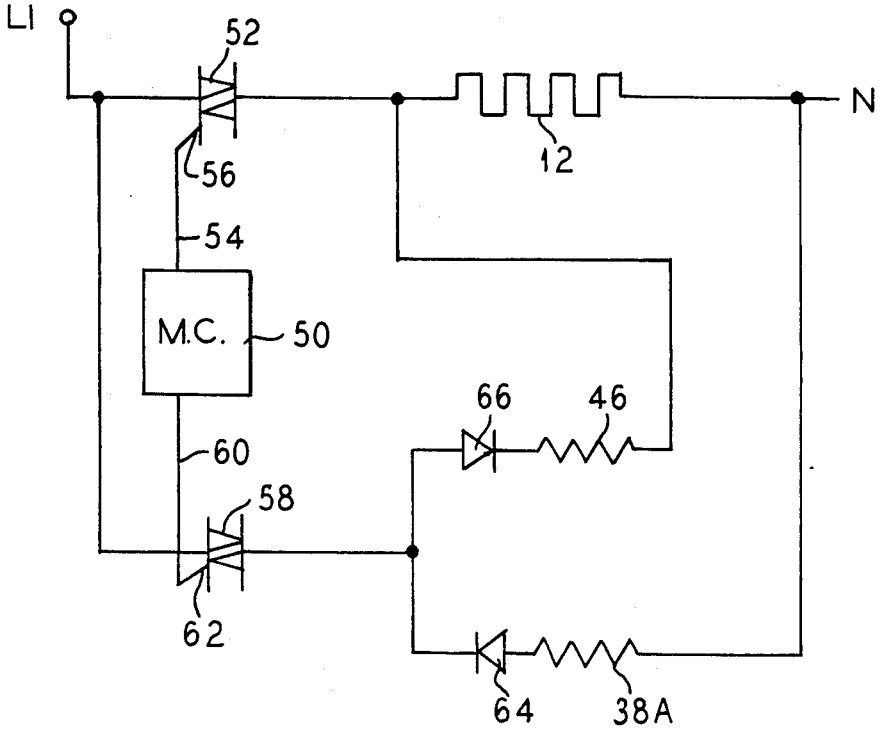
FIG. 6 is a schematic diagram showing an alternative embodiment of the improved circuit of the invention.

It will be appreciated by those skilled in the art that one or the other of the two actuators might be of low resistance while the other is of high resistance thereby requiring that the actuator of low resistance be connected in series with the heater and that combination be in parallel with the high resistance actuator such as shown in FIG. 6.

The firing of the triac 58 would be the same in any such configuration, that is, the triac would be fired at the beginning of positive half line cycles for one actuator and at the beginning of negative half line cycles for the other actuator. The operation of the heater triac would be altered slightly in the event that the heater is to be energized simultaneously with one or more of the actuators. If a particular actuator is to be energized at the same time as the heater and if the heater is connected in series with that actuator, then the heater triac 52 will need to be fired at the beginning of alternate half line cycles from those being used to energize the actuator. If the actuator is connected in parallel with the heater, then the triac 52 would need to be either fired at the beginning of each half line cycle or continuous biassing of the triac 52 into low impedance could be provided.

Thus, the invention permits the use of a single triac to energize two separate actuators rather than requiring the use of two separate triacs. An obvious cost saving results. This is achieved through phase control of the dual purpose triac by the microcomputer.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a dishwasher apparatus having an electric detergent dispenser operator, an electric wetting agent dispenser operator, and control means for cyclically operating the dishwasher through washing, rinsing and drying operations, improved circuit means operated by said control means for selectively electrically connecting said wetting agent dispenser operator and said detergent dispenser operator selectively to an alternating current power supply, said circuit means comprising:

said wetting agent dispenser operator and said detergent dispenser operator being connected in parallel, and first means connected in series with said parallel connection of said operators for directing selected positive half cycles and alternatively selected negative half cycles of said alternating current to said parallel connection of said operators, second means connected in series with a first one of said operators for passing positive half cycles of current through said first one of said operators while excluding passage of negative half cycles therethrough, and third means connected in series with a second one of said operators, for passing negative half cycles of current through said second operator while excluding passage of positive half cycles therethrough.

2. A dishwasher apparatus according to claim 1, wherein said means for directing selected positive half cycles and alternatively selected negative half cycles of said alternating current comprises a single triac operated by said control means and said second and third means comprise a pair of oppositely directed diodes, one diode connected in series with said wetting agent dispenser operator and one diode connected in series with said detergent dispenser operator.

3. A dishwasher apparatus according to claim 1, including an electric heater operated by said control means, wherein at least one of said operators has a low electrical resistance and that operator is connected in series with said heater.

4. A dishwasher apparatus according to claim 1, including an electric heater operated by said control means, wherein at least one of said operators has a high electrical resistance and that operator is connected in parallel with said heater.

5. In a dishwasher apparatus having an electric heater, an electric wetting agent dispenser operator, an electric detergent dispenser operator, and control means for cyclically operating the dishwasher through washing, rinsing and drying operations, improved circuit means operated by said control means for electrically connecting said heater, said wetting agent dispenser operator, and said detergent dispenser operator selectively to an alternating current power supply, said circuit means comprising:

first switching means connected in series with said heater for selectively energizing said heater;

said wetting agent dispenser operator and said detergent dispenser operator being connected in parallel;

second switching means connected in series with said parallel connection of said operators, switch control means for causing said second switching means to selectively be in an open state, to pass positive half cycles or to pass negative half cycles of said alternating current, and current flow limiting means for permitting positive current flow through a first one of said operators while prohibiting such flow through the other and means for permitting negative current flow through the other of said operators while prohibiting such flow through the first one.

6. A dishwasher apparatus according to claim 5, wherein said first and second switching means are triacs and said current flow limiting means comprise an oppositely directed diode in series with each operator.

7. A dishwasher apparatus according to claim 6, wherein switch control means comprises a microcomputer to selectively bias said second triac into low impedance at the selected beginning of one of a positive half cycle or a negative half cycle.

8. A dishwasher apparatus according to claim 7, wherein at least one of said operators has a low electrical resistance and that operator is connected in series with said heater.

9. A dishwasher apparatus according to claim 8, wherein said microcomputer is configured to bias said first triac into low impedance at a beginning of an opposite half cycle from that used to energize said at least one operator when said heater is to be energized simultaneously with said at least one operator.

10. In a dishwasher apparatus having an electric detergent dispenser operator, an electric wetting agent dispenser operator, and control means for cyclically operating the dishwasher through washing, rinsing and drying operations, improved circuit means operated by said control means for selectively electrically connecting said wetting agent dispenser operator and said detergent dispenser operator selectively to an alternating current power supply, said circuit means comprising:

said wetting agent dispenser operator and said detergent dispenser operator being connected in parallel, and means comprising a single triac operated by said control means and a pair of oppositely directed diodes, one diode connected in series with said wetting agent dispenser operator, one diode connected in series with said detergent dispenser operator and said triac being connected in series with said parallel connection of said operators for directing selected positive half cycles of said alternating current through a first one of said operators while excluding passage through the other and for directing selected negative half cycles through the other operator while excluding passage through the first one, said wetting agent dispenser operator and said detergent operator both having low electrical resistance, and both being connected in series with said heater.

11. In a dishwasher apparatus having an electric detergent dispenser operator, an electric wetting agent dispenser operator, and control means for cyclically operating the dishwasher through washing, rinsing and drying operations, improved circuit means operated by said control means for selectively electrically connecting said wetting agent dispenser operator and said detergent dispenser operator selectively to an alternating current power supply, said circuit means comprising:

said wetting agent dispenser operator and said detergent dispenser operator being connected in parallel, and means comprising a single triac operated by said control means and a pair of oppositely directed diodes, one diode connected in series with said wetting agent dispenser operator and one diode connected in series with said detergent dispenser operator and said triac being connected in series with said parallel connection of said operators for directing selected positive half cycles of said alternating current through a first one of said operators while excluding passage through the other and for directing selected negative half cycles through the other operator while excluding passage through the first one, said wetting agent dispenser operator and said detergent operator both having high electrical resistance, and both being connected in parallel with said heater.

12. In a dishwasher apparatus having an electric detergent dispenser operator, an electric wetting agent dispenser operator, and control means for cyclically operating the dishwasher through washing, rinsing and drying operations, improved circuit means operated by said control means for selectively electrically connecting said wetting agent dispenser operator and said detergent dispenser operator selectively to an alternating current power supply, said circuit means comprising:

said wetting agent dispenser operator and said detergent dispenser operator being connected in parallel, and means comprising a single triac operated by said control means and a pair of oppositely directed diodes, one diode connected in series with said wetting agent dispenser operator, one diode connected in series with said detergent dispenser operator and said triac being connected in series with said parallel connection of said operators for directing selected positive half cycles of said alternating current through a first one of said operators while excluding passage through the other and for directing selected negative half cycles through the other operator while excluding passage through the first one, one of said wetting agent dispenser operator and said detergent operator both having high electrical resistance and being connected in parallel with said heater and the other of said operators having low electrical resistance and being connected in series with said heater.

13. A dishwasher apparatus according to claim 1, wherein said first means comprises a switch control means for causing a switching means to selectively be in an open state, to pass positive half cycles or to pass negative half cycles of alternating current, and said second and third means comprise current flow limiting means for permitting positive current flow through a first one of said operators while prohibiting such flow through the other and means for permitting negative current flow through the other of said operators while prohibiting such flow through said first one.

* * * * *